US010358805B2

(12) United States Patent
Tanimoto et al.

(10) Patent No.: US 10,358,805 B2
(45) Date of Patent: Jul. 23, 2019

(54) FIXING DEVICE FOR WALL-MOUNTED TYPE TOILET AND TOILET SYSTEM

(71) Applicant: TOTO LTD., Kitakyushu-shi, Fukuoka (JP)

(72) Inventors: Hideki Tanimoto, Kitakyushu (JP); Tomoyoshi Taketani, Kitakyushu (JP); Takashi Matsusaki, Kitakyushu (JP); Makoto Abe, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

(21) Appl. No.: 15/879,331

(22) Filed: Jan. 24, 2018

(65) Prior Publication Data

US 2018/0216328 A1 Aug. 2, 2018

(30) Foreign Application Priority Data

Jan. 30, 2017 (JP) ..... 2017-014684
Nov. 30, 2017 (JP) ..... 2017-230689

(51) Int. Cl.
*E03D 1/012* (2006.01)
*E03D 11/14* (2006.01)
*E03D 5/10* (2006.01)

(52) U.S. Cl.
CPC ..... *E03D 1/0125* (2013.01); *E03D 11/146* (2013.01); *E03D 5/10* (2013.01)

(58) Field of Classification Search
CPC ..... E03D 1/0125; E03D 11/146; E03D 5/10; E03D 11/14; E03D 11/143
USPC ..... 4/419
See application file for complete search history.

(56) References Cited

U.S. PATENT DOCUMENTS 6,035,589 A * 3/2000 Schmucki ..... E03C 1/328 248/188.5
6,128,787 A * 10/2000 Krist ..... E03D 11/146 4/252.2
2010/0065699 A1* 3/2010 Tremp ..... E03D 11/146 248/205.3
2014/0310860 A1* 10/2014 Wroblewski ..... E03D 11/14 4/252.1
2016/0090726 A1* 3/2016 Verdecchia ..... E03D 11/143 4/252.1
2016/0097191 A1* 4/2016 Morris ..... E03D 11/14 4/252.1

* cited by examiner

*Primary Examiner* — Huyen D Le
(74) *Attorney, Agent, or Firm* — Baker & Hostetler LLP

(57) ABSTRACT

A wall-mounted type toilet fixing device includes a flush water tank device that is hidden in an area behind a wall, and a fixing unit, the fixing unit includes support portions, a toilet fixing portion, a pair of left and right legs, and a drain pipe connection, and the pair of legs are disposed outside from the drain pipe connection and inside from a side wall of a toilet body in elevation view, and are disposed laterally asymmetrically to each other with respect to a central axis passing through a center of the drain pipe connection and dividing the fixing unit equally in a left-right direction, in a state where the toilet body is fixed to the toilet fixing portion.

10 Claims, 8 Drawing Sheets

FIXING DEVICE FOR WALL-MOUNTED TYPE TOILET AND TOILET SYSTEM

TECHNICAL FIELD

The present invention relates to a fixing device for a wall-mounted type toilet and a toilet system, and particularly relates to a toilet fixing device for fixing a rear side of a flush toilet including a warm water washing device to a wall, and a toilet system.

BACKGROUND

In the flush toilets including warm water washing devices, there has been conventionally a so-called "wall-mounted type toilet" which is a type of fixing the rear side thereof to the wall. As for the wall-mounted type toilets which include warm water washing devices like this, the rear sides of the toilets are fixed to the walls by using fixing devices for wall-mounted type toilets as described in, for example, Patent document 1 (EP 2568089 A1), and Patent document 2 (EP 2770125 A2).

FIG. 8 is a schematic view illustrating a conventional fixing device for a wall-mounted type toilet.

As illustrated in FIG. 8, in a conventional wall-mounted type toilet fixing device 200 described in each of the aforementioned. Patent documents 1 and 2, a flush water tank device 204 that is hidden in an area R201 behind a wall W201 and supplies flush water to a flush toilet 202 is included.

In FIG. 8, the wall W 201 which is provided between a rear end of the flush toilet 202 and the wall-mounted type toilet fixing device 200 is partially omitted.

Next, as illustrated in FIG. 8, the conventional fixing device 200 includes support columns 208 that are provided in the area R201 behind the wall W201, fix the flush water tank device 204 and fix a rear end portion of a toilet body 206 of the flush toilet 202 to the wall W201. The support columns 208 are provided at both left and right sides of the flush water tank device 204 to extend in a vertical direction to support the flush water tank device 204. Lower portions of the respective support columns 208 are legs 210 that are fixed to a floor F201 in the area behind the wall.

As illustrated in FIG. 8, the conventional fixing device 200 includes a toilet fixing plate 212 of a metal which is provided so as to connect a pair of left and right support columns 208 and extends in a left-right direction. The rear end portion of the toilet body 206 is fixed to the toilet fixing plate 212 via the wall W201.

Further, as illustrated in FIG. 8, a lateral frame 214 that extends in the left-right direction to connect the pair of left and right support columns 208 is provided below the toilet fixing plate 212. At an upper end of the lateral frame 214, a drain pipe connection 218 capable of connecting an inlet 216*a* of a drain pipe 216 extending upward from the floor F201 in the area 8201 behind the wall W201 and a discharge outlet 206*a* at a rear side of the toilet body 206 via the wall W201 is provided.

Next, as illustrated in FIG. 8, in the conventional fixing device 200, a position in a vertical direction of the toilet fixing plate 212 is located in a vicinity of a substantially middle position between the floor F201 and the upper end of the support column 208.

Further, as illustrated in FIG. 8, in the conventional fixing device 200, in a state where the toilet body 206 is fixed to the toilet fixing plate 212, a pair of legs 210 are disposed outside from side walls 206*b* of the toilet body 206 in elevation view As illustrated in FIG. 8, in the conventional fixing device 200, the pair of legs 210 are disposed laterally symmetrically to each other with respect to a central axis A201 passing through a center O201 of the drain pipe connection 218 and dividing a space between the support columns 208 equally in a left-right direction in elevation view.

Next, as illustrated in FIG. 8, in the conventional fixing device 200, a front end surface of the lateral frame 214 forms a load receiving surface S201 that receives a load which acts to the lateral frame 214 via the wall from a rear of the toilet body 206 at a time of use of the flush toilet 202.

Further, as illustrated in FIG. 8, in the conventional fixing device 200, a position in the vertical direction of the load receiving surface S201 of the lateral frame 214 is set above a lower end of the toilet body 206.

However, as illustrated in FIG. 8, in the conventional fixing device 200, a distance H201 in the vertical direction from the floor F201 to a lowest position of the load receiving surface S201 of the lateral frame 214 is set to be larger than one-third of a distance H202 in the vertical direction from the floor F201 to a lower end of the toilet fixing plate 212, and the distance is set to be relatively large.

Further, as illustrated in FIG. 8, in the conventional fixing device 200, the legs 210 at both sides are disposed outside from the side walls 206*b* of the toilet body 206 in elevation view, so that there is the problem that when a load acts on the load receiving surface S201 of the lateral frame 214 via the wall from the rear of the toilet body 206 at the time of use of the flush toilet 202, the amounts by which the lateral frame 214 and the legs 210 at both sides thereof are deformed become large, and the entire fixing device 200 is inclined.

Accordingly, there are the problems that it becomes difficult to hide the flush water tank device 204 in the area R201 behind the wall W201 and fix the flush water tank device 204 reliably, and it also becomes difficult to fix the rear end portion of the toilet body 206 of the flush toilet 202 to the wall W201 reliably.

Consequently, in the fixing device for a wall-mounted type toilet, it is the problem requested to be solved in recent years how to hide the flush water tank device in the area behind the wall and fix the flush water tank device reliably, and to fix a wall-mounted type toilet to the wall reliably.

Along with globalization of the flush toilets including warm water washing devices to overseas markets in recent years, the design aspects related to the entire toilet system, the toilet peripheral portions and the like have various needs and diversified.

In particular, the equipment that supplies water to, and the equipment that supplies power to the warm water washing device of a flush toilet and the flush water tank device are provided in a periphery of the fixing device for the wall-mounted type toilet, and with respect to these kinds of peripheral equipment, how to ensure maintainability while adopting a design hardly seen from outside has been the problem requested to be solved in recent years.

Thus, the present invention is made to solve the problem of the prior art and the problem requested to be solved in recent years, and has an object to provide a fixing device for a wall-mounted type toilet that can hide a flush water tank device in an area behind a wall and fix the flush water tank reliably, and can fix a flush toilet to a wall reliably, and a toilet system.

SUMMARY

In order to solve the aforementioned problem, the present invention provides a toilet fixing device for fixing a rear side of a flush toilet including a warm water washing device to a wall, the wall-mounted type toilet fixing device comprising: a flush water tank device configured to supply flush water to the flush toilet, the flush water tank device being disposed behind the wall so as to be hidden by the wall; and a fixing unit that is disposed behind the wall so as to be hidden by the wall, the fixing unit being configured to fix the flush water tank device and to fix a rear end portion of a toilet body of the flush toilet to the wall, wherein the fixing unit includes: a pair of left and right support portions that are configured to extend in a vertical direction at both left and right sides of the flush water tank device and to support the flush water tank device, a toilet fixing portion extending in a left-right direction to connect the pair of left and right support portions, the toilet fixing portion being configured to fix the rear end portion of the toilet body via the wall, a pair of left and right legs extending downward from the toilet fixing portion, the pair of left and right legs being fixed to a floor in an area behind the wall, and a drain pipe connection disposed in the toilet fixing portion, the drain pipe connection being configured to connect an inlet of a drain pipe extending from the floor in the area behind the wall to be close to the toilet fixing portion and a discharge outlet at a rear side of the toilet body via the wall, wherein the toilet fixing portion is located below an intermediate position between the floor in the area behind the wall and upper ends of the support portions, the pair of legs are disposed outside from the drain pipe connection and inside from a side wall of the toilet body in elevation view, and are disposed laterally asymmetrically to each other with respect to a central axis passing through a center of the drain pipe connection and dividing the fixing unit equally in the left-right direction, in a state where the toilet body is fixed to the toilet fixing portion, and respective front end surfaces of the pair of legs are load receiving surfaces configured to receive a load acting toward the legs from a rear of the toilet body via the wall at a time of use of the flush toilet.

According to the invention described above, the toilet fixing portion is located below the intermediate position between the floor surface in the area behind the wall and the upper ends of the support portions.

Further, the pair of legs in the state where the toilet body is fixed to the toilet fixing portion are disposed outside from the drain pipe connection and inside from the side walls of the toilet body in elevation view. In addition, the respective front end surfaces of the pair of legs are load receiving surfaces that receive a load acting toward the legs from the rear of the toilet body via the wall at the time of use of the flush toilet.

Thereby, as compared with the case in which the legs are disposed outside from the side walls of the toilet body in elevation view, the load receiving surfaces of the legs can be limited to a small range. Thereby, a deformation amount of the entire wall-mounted type toilet fixing device bending or the like by the load acting to the legs from the rear of the toilet body via the wall can be restrained.

Accordingly, by the fixing unit, the flush water tank device is hidden in the area behind the wall and can be reliably fixed, and the rear end portion of the toilet body of the flush toilet can be reliably fixed to the wall.

Further, the pair of legs are disposed laterally asymmetrically to each other with respect to the central axis passing through the center of the drain pipe connection and dividing the fixing unit equally in the left-right direction.

Thereby, in the area behind the wall, the legs of the fixing unit can be freely positioned in the area outside from the drain pipe connection and inside from the side walls of the toilet body in elevation view. Thereby, for example, equipment that supplies water to and equipment that supplies power to the warm water washing device of the flush toilet and the flush water tank device can be freely positioned in a periphery of the legs, and the degree of freedom of design can be enhanced.

In the present invention, it is preferable that toilet fixing device according to claim 1, further comprising: a water supply main pipe configured to supply flush water supplied from a water supply source to the respective flush water tank device and warm water washing device, the water supply main pipe being disposed behind the wall so as to be hidden by the wall; and a stopcock disposed on a connecting portion configured to connect the water supply main pipe and a water supply pipe for warm water washing extending from the warm water washing device, wherein the stopcock is fixed to either one of the pair of legs, and a front end of the stopcock is disposed at a height position between the floor and a lower end of the toilet body so as to be accessible from a front side of the wall.

According to the invention described above, the stopcock is fixed to either one of the pair of legs, and the front end of the stopcock is disposed at the height position between the floor and the lower end of the toilet body to be accessible from the front side of the wall, so that an installation space for the stopcock can be ensured in the area behind the wall, and the stopcock can be disposed at a position that is hard to see from outside.

Further, when a water stopping operation is performed at a time of emergency and in maintenance at a normal time, the front end of the stopcock is easily accessible, so that the water stopping operation can be performed easily.

Further, most part of the stopcock other than the front end can be hidden by the wall, irrespective of the shape of the toilet body, so that the device can be hardly restricted by the shape of the toilet body.

Consequently, the device can correspond to toilet bodies of various designs.

In the present invention, it is preferable that the toilet fixing device according further comprises an electric component disposed in the flush toilet or the flush water tank device; and a power supply connection configured to be hidden in the area behind the wall, wherein a power supply portion supplying power to the electric component is connected to the power supply connection, wherein the power supply connection is disposed in a vicinity of an outside of either one leg of the pair of legs.

According to the invention described above, the power supply connection is disposed in the vicinity of the outside of either one leg of the pair of legs, so that an installation space for the power supply connection can be ensured in the area behind the wall, and the power supply connection can be disposed at the position which is hard to see from outside.

Further, irrespective of the shape of the toilet body, the power supply connection can be hidden by the wall, so that the device can be hardly restricted by the shape of the toilet body.

Consequently, the device also can correspond to toilet bodies of various designs.

In the present invention, it is preferable that the pair of legs include a first leg and a second leg, a first distance to the first leg from the central axis dividing the fixing unit equally in a left-right direction is set to be longer than a second distance from the central axis to the second leg, and the stopcock is fixed to the first leg.

According to the invention described above, the installation space for the stopcock that is hidden in the area behind the wall can be ensured, and the stopcock can be disposed at the position which is hard to see from the front side of the wall.

Further, the stopcock can be disposed at the position where a water stopping operation is easily performed from the front side of the wall at the time of emergency and in the maintenance at the normal time.

In the present invention, it is preferable that the toilet fixing device further comprises: an electric component disposed in the flush toilet or the flush water tank device; and a power supply connection configured to be hidden in the area behind the wall, wherein a power supply portion supplying power to the electric component is connected to the power supply connection, wherein the power supply connection is disposed inside of the first leg with the stopcock.

According to the invention described above, the first distance to the first leg from the central axis dividing the fixing unit equally in the left-right direction is set to be longer than the second distance to the second leg from the central axis dividing the fixing unit equally in the left-right direction, so that the space wider than the space inside from the second leg is formed inside from the first leg.

Accordingly, by effectively using the space formed inside from the first leg as the installation space for the power supply connection and the stopcock, the power supply connection and the stopcock can be disposed at the position which is hard to see from the front side of the wall.

Further, in the state where the rear end portion of the toilet body is fixed to the wall by the fixing unit, the respective power supply connection and stopcock are disposed at a central side of the toilet body, so that even when the device is applied to toilet bodies of various modes, power supply connections and the stopcocks of the toilet bodies can be reliably hidden in lateral widths of the toilet bodies.

In the present invention, it is preferable that the power supply connection is disposed above in a substantially vertical direction with respect to the stopcock and above a lower end of the inlet of the drain pipe.

According to the invention described above, the power supply connection is disposed above in the substantially vertical direction with respect to the stopcock and above the lower end of the inlet of the drain pipe, and thereby the space in the vertical direction from the stopcock to the power supply connection can be sufficiently ensured.

Accordingly, even in the situation where piping (so-called "lateral piping") installing the drain pipe in the posture inclined with respect to the vertical direction is more preferable than piping (so-called "vertical piping") installing the drain pipe in the posture extended in the vertical direction, due to the installation situation of the position or the like of the piping at the downstream side of the drain pipe, for example, the drain pipe can be properly disposed in the space between the stopcock and the power supply connection.

Thereby, the vertical piping and the lateral piping can be properly selected in accordance with the piping installation at the downstream side of the drain pipe, so that the device can be also applied variously to various installation places.

Further, the power supply connection is disposed inside of the first leg with the stopcock, and is disposed above in the substantially vertical direction with respect to the stopcock, whereby when one of the power supply connection and the stopcock is fixed to inside of the first leg once at the time of performing work of fixing the power supply connection and the stopcock to the inside of the first leg, the other one can be easily positioned and fixed to the inside of the first leg, so that workability can be enhanced.

In the present invention, it is preferable that a distance in a left-right horizontal direction from the central axis to the stopcock is set at 80 mm to 95 mm.

According to the invention described above, the installation space for the stopcock which is hidden in the area behind the wall can be ensured, and the stopcock can be disposed at the position which is hard to see from the front side of the wall.

Further, the stopcock can be disposed at the position where a water stopping operation is easily performed from the front side of the wall at the time of emergency and in the maintenance at the normal time.

In the present invention, it is preferable that a distance in the vertical direction from the floor to the stopcock is set at 30 mm to 157 mm.

In the present invention configured in this way, the installation space for the stopcock that is hidden in the area behind the wall can be ensured, and the stopcock can be disposed at the position which is hard to see from the front side of the wall.

Further, the stopcock can be disposed at the position where the water stopping operation is easily performed from the front side of the wall at the time of emergency and in the maintenance at the normal time.

In the present invention, it is preferable that a distance in the vertical direction from the floor to a lowest position of the load receiving surfaces of the legs is set at 55 mm to 182 mm.

According to the invention described above, the distance in the vertical direction between the load receiving surfaces of the legs and the floor can be set to be relatively small, so that even if a load acts on the load receiving surfaces of the legs via the wall from the rear of the toilet body at the time of use of the flush toilet, the deformation amounts of the legs and the wall at the front side of the legs can be restrained.

Further, the present invention is a toilet system including the toilet fixing device and the flush toilet fixed to the toilet fixing device via the wall.

According to the invention described above, by the toilet fixing device, the toilet system in which the flush water tank device is hidden in the area behind the wall and fixed reliably, and the flush toilet is reliably fixed to the wall can be provided.

According to the wall-mounted type toilet fixing device of the present invention, the flush water tank device can be hidden in the area behind the wall and fixed reliably, and the flush toilet can be reliably fixed to the wall.

DETAILED DESCRIPTION

Hereinafter, a wall-mounted type toilet fixing device according to a first embodiment of the present invention will be described with reference to FIGS. 1 to 5.

Figure 1:
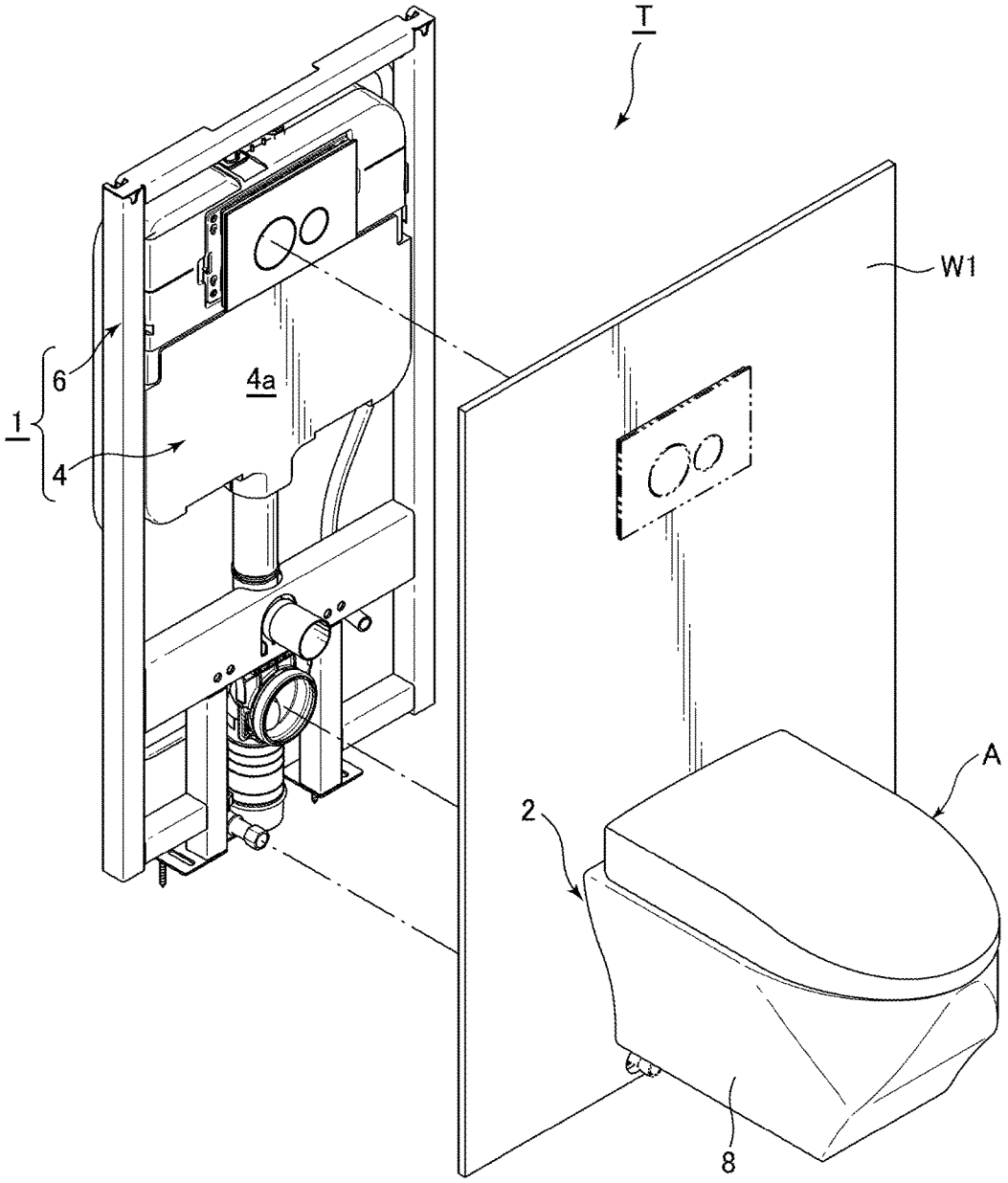
FIG. 1 is a schematic exploded perspective view illustrating a wall-mounted type toilet fixing device according to a first embodiment of the present invention, and a flush toilet that is fixed to the wall-mounted type toilet fixing device via a wall.

First, FIG. 1 is a schematic exploded perspective view illustrating the wall-mounted type toilet fixing device according to the first embodiment of the present invention, and a flush toilet that is fixed to the wall-mounted type toilet fixing device via a wall.

Figure 2:
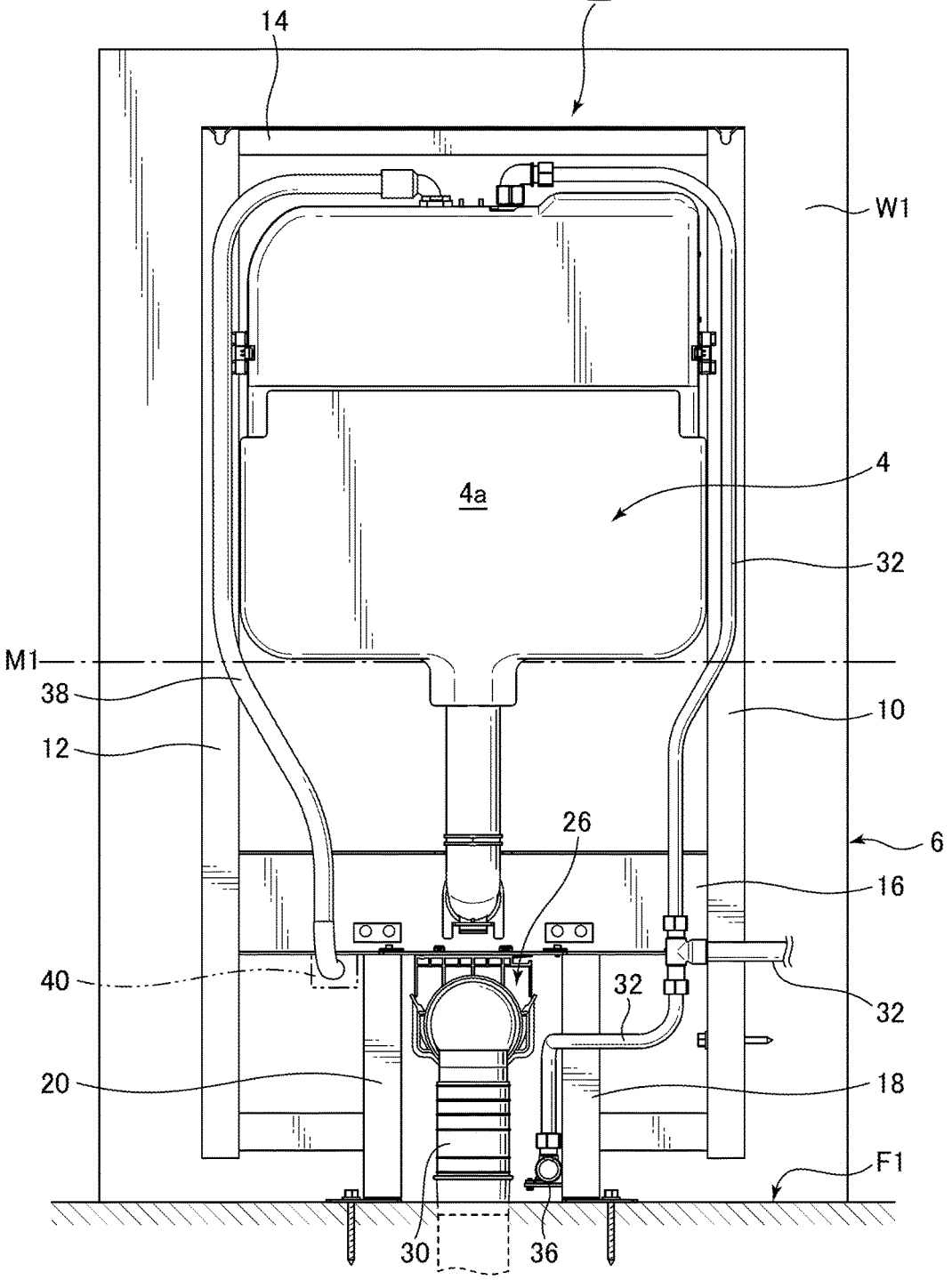
FIG. 2 is a rear view of the wall-mounted type toilet fixing device according to the first embodiment of the present invention and the wall.

Next, FIG. 2 is a rear view of the wall-mounted type toilet fixing device according to the first embodiment of the present invention and the wall.

Figure 3:
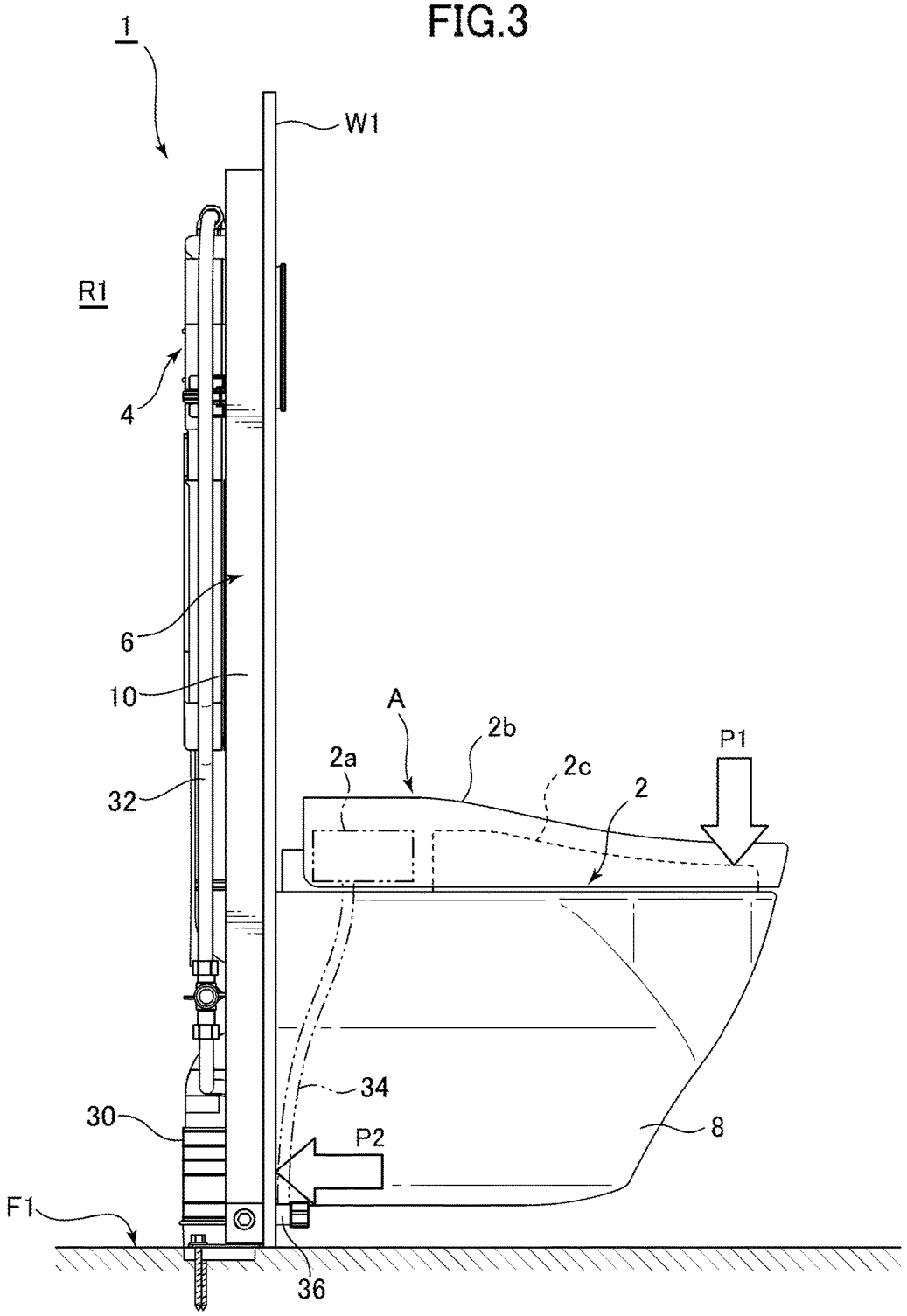
FIG. 3 is a left side view illustrating the wall-mounted type toilet fixing device according to the first embodiment of the present invention, and the flush toilet that is fixed to the wall-mounted type toilet fixing device via the wall.

FIG. 3 is a left side view illustrating the wall-mounted type toilet fixing device according to the first embodiment of the present invention, and the flush toilet that is fixed to the wall-mounted type toilet fixing device via the wall.

Figure 4:
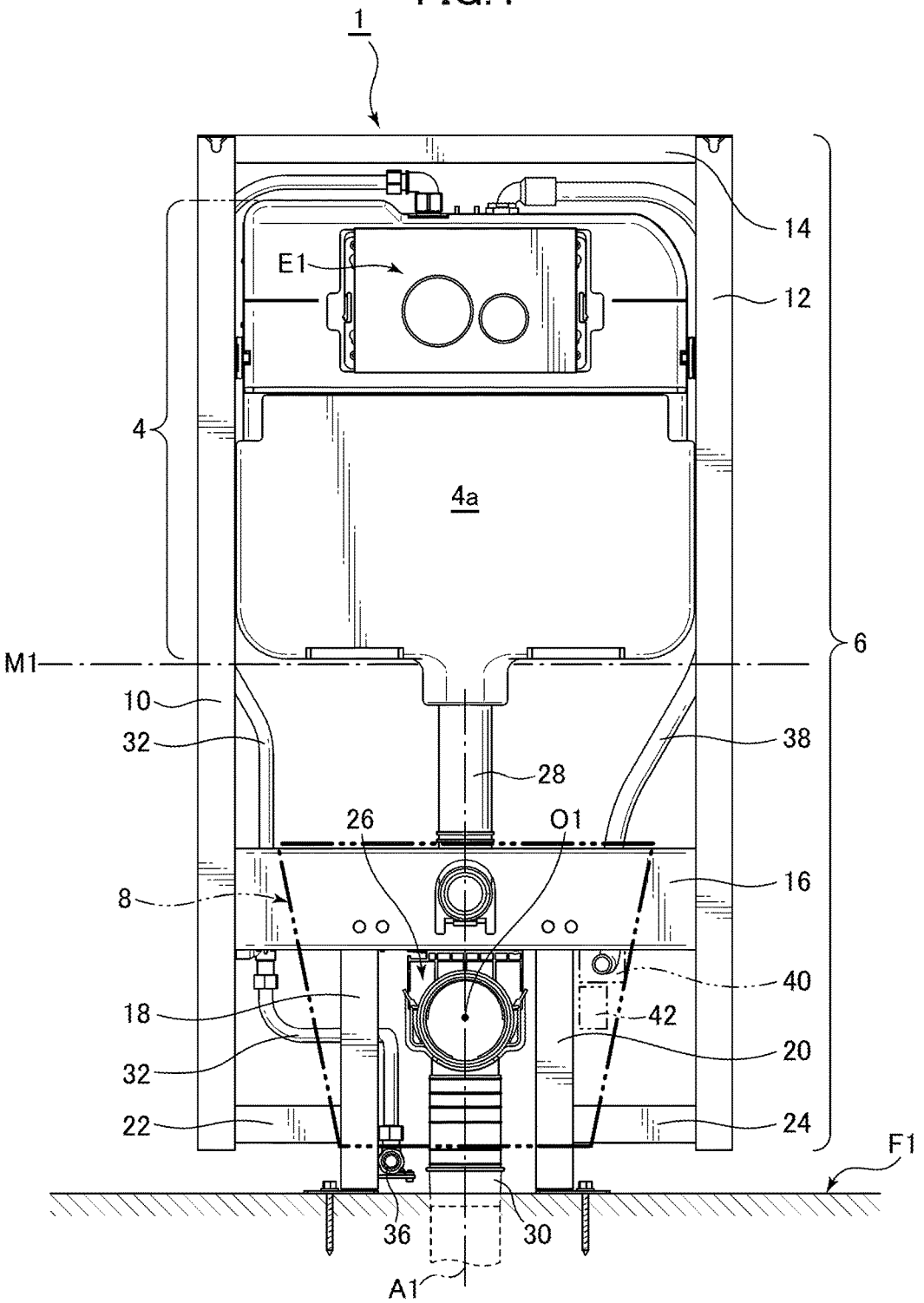
FIG. 4 is a front view of the wall-mounted type toilet fixing device according to the first embodiment of the present invention.

Further, FIG. 4 is a front view of the wall-mounted type toilet fixing device according to the first embodiment of the present invention.

Here, in the wall-mounted type toilet fixing device illustrated in FIG. 4, an outside shape of a toilet body of the flush toilet which is fixed is illustrated by a chain line.

First, as illustrated in FIG. 1, a wall-mounted type toilet fixing device 1 according to the first embodiment of the present invention is a part of a toilet system T, and enables a rear side of a wall-mounted type flush toilet 2 including a toilet seat unit A with a warm water washing function to be fixed to a wall (a wall W1) of a toilet room.

Specifically, as illustrated in FIG. 1, the wall-mounted type toilet fixing device 1 of the present embodiment includes a flush water tank device 4 and a fixing unit 6 in an area R1 behind the wall W1.

First, as illustrated in FIGS. 1 to 4, the flush water tank device 4 of the fixing device 1 includes a gravity water supply type water storage tank 4*a* that is provided to be capable of being hidden in the area R1 behind the wall W1, and supplies flush water to the flush toilet 2 by using the gravity for the flush water in the water storage tank 4*a*.

Explanation of details of an internal structure of the water storage tank 4*a* of the flush water tank device 4 will be omitted, but typically, a water supply device (not illustrated) that supplies water into the water storage tank 4*a* is provided, and a discharge valve device (not illustrated) including an electric component that electrically drives a discharge valve (not illustrated) that opens and closes a discharge port (not illustrated) of the water storage tank 4*a* and the like are provided. A water supply and discharge operations in the flush water tank device 4 by the water supply device (not illustrated) and the discharge valve device (not illustrated) are manually operated by a button operation or the like on an operation panel E1 provided on a front surface of the flush water tank device 4, for example, and the discharge valve device (not illustrated) and the like are capable of being actuated in association with the button operation. However, the operation panel E1 may be an electric component capable of transmitting and receiving electric operation signals, and may electrically actuate the discharge valve device (not illustrated) and the like based on the electric operation signals that are transmitted and received between the operation panel E1 and respective electric components (not illustrated) in the flush water tank device 4.

Further, the flush toilet 2 may be a so-called wash down type flush toilet that washes down excrement in a bowl portion (not illustrated) by a drop in a height direction of the bowl portion (not illustrated) in a toilet body 8, or may be of modes of other flush toilets such as a so-called siphon type toilet that sucks excrement in a bowl portion (not illustrated) and discharges the excrement from a drain trap conduit (not illustrated) by using a siphon action.

Further, as illustrated in FIGS. 1 and 3, the toilet seat unit A with a warm water washing function of the flush toilet 2 includes a plurality of electric components (not illustrated) that are actuated electrically, and typically includes a warm water washing device 2*a* including a partial washing nozzle (not illustrated).

Further, the toilet seat unit A includes a toilet seat 2*c* which is provided on a top surface of the toilet body 8 and is covered with a toilet lid 2*b*.

Next, as illustrated in FIGS. 1 to 4, the fixing unit 6 of the fixing device 1 is provided in the area R1 behind the wall W1 to be capable of being hidden, fixes the flush water tank device 4 and fixes a rear end of the toilet body 8 of the flush toilet 2 to a front side surface (front surface) of the wall W1.

Specifically, as illustrated in FIGS. 2 to 4, the fixing unit 6 includes a pair of left and right vertical frames (a left vertical frame 10 and a right vertical frame 12), an upper lateral frame 14, a toilet fixing lateral frame 16, a pair of left and right leg frames 18 and 20 (a left leg frame 18 and a right leg frame 20), left and right lower lateral frames 22 and 24 (a left lower lateral frame 22 and a right lower lateral frame 24), and a drain pipe connection 26.

Further, as illustrated in FIGS. 2 to 4, the pair of left and right vertical frames 10 and 12 of the fixing unit 6 are provided to extend in the vertical direction at both left and right sides of the water storage tank 4*a* of the flush water tank device 4, and are support portions that support the flush water tank device 4 from both left and right sides. Lower ends of the respective vertical frames 10 and 12 are located above a floor F I and are not grounded.

Further, as illustrated in FIGS. 2 and 4, the upper lateral frame 14 of the fixing unit 6 is provided to connect upper ends of the pair of left and right vertical frames 10 and 12.

Figure 5:
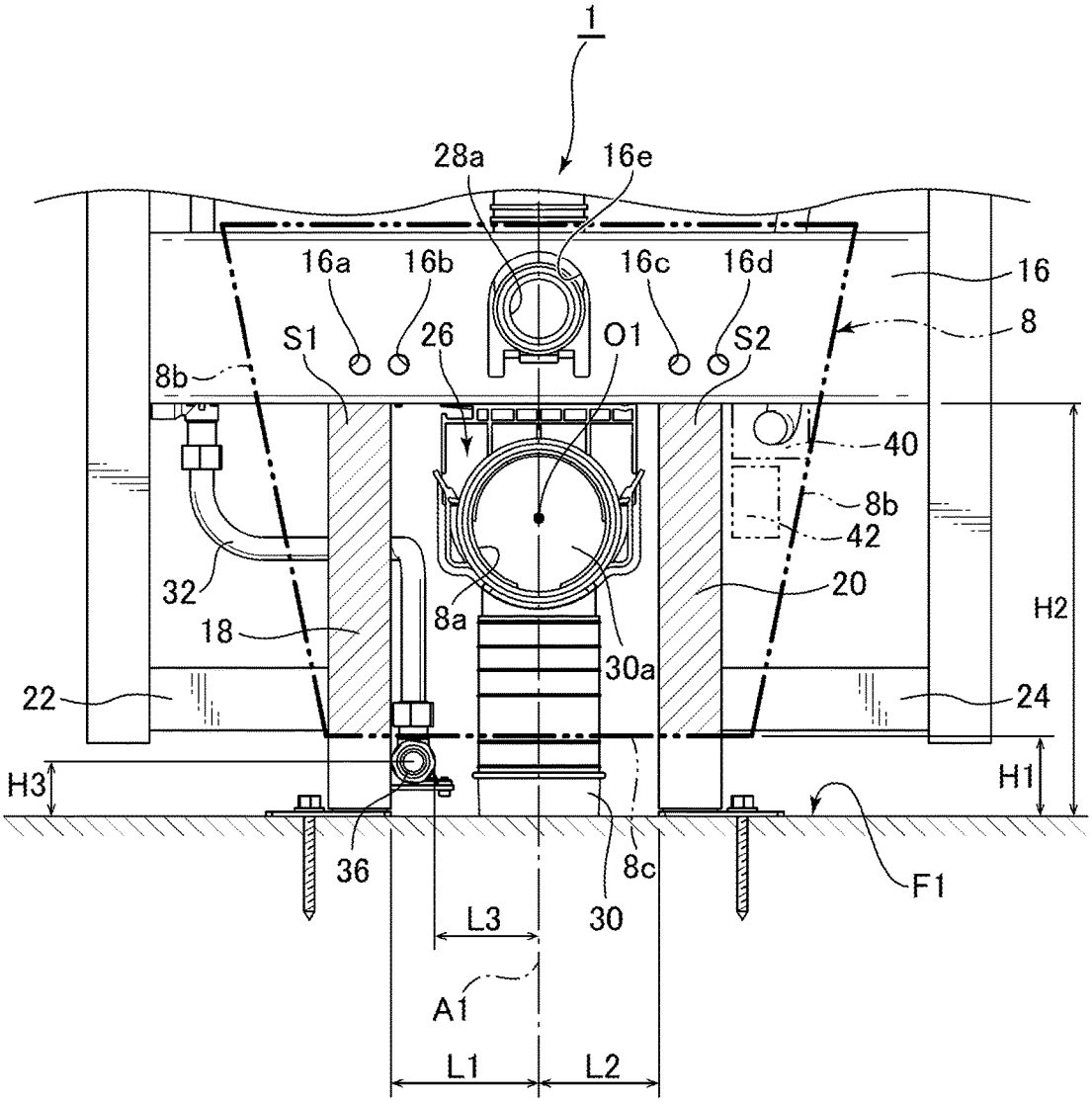
FIG. 5 is a partial enlarged view in which a lower part of the wall-mounted type toilet fixing device according to the first embodiment of the present invention illustrated in FIG. 4 is enlarged.

Next. FIG. 5 is a partial enlarged front view in which a lower part of the wall-mounted type toilet fixing device according to the first embodiment of the present invention illustrated in FIG. 4 is enlarged.

Here, in the wall-mounted type toilet fixing device 1 illustrated in FIGS. 4 and 5, the outside shape of the toilet body 8 is illustrated by chain lines.

As illustrated in FIGS. 2, 4 and 5, a position in the vertical direction of the toilet fixing lateral frame 16 of the fixing unit 6 is located below an intermediate position M1 in the vertical direction between the floor F1 and the upper ends of both the vertical frames 10 and 12 in the area R1 behind the wall W1.

The toilet fixing lateral frame 16 connects the pair of left and right vertical frames 10 and 12 to each other, and is a toilet fixing portion to which a rear end portion of the toilet body 8 is fixed via W1.

More specifically, as illustrated in FIG. 5, in the toilet fixing lateral frame 16, a total of four toilet fixing screw hoes 16*a*, 16*b*, 16*c* and 16*d* are formed, two on each of left and right sides laterally symmetrically with respect to a central axis A1 dividing the fixing unit 6 equally in a left-right direction of the fixing unit 6.

Further, fixing bolts (not illustrated) that are screwed into the respective screw holes 16*a*, 16*b*, 16*c* and 16*d* are fixed to the rear end portion of the toilet body 8. The respective fixing bolts (not illustrated) are capable of being fastened by fixing nuts (not illustrated) fastened to the respective screw holes 16*a*, 16*b* 16*c* and 16*d* via the wall W1. Thereby, the rear end portion of the toilet body 8 is fixed to the toilet fixing lateral frame 16 via the wall W1.

Further, as illustrated in FIGS. 4 and 5, in a substantially central portion in the left-right direction of the toilet fixing lateral frame 16, a retaining hole 16*e* is formed, which retains an outlet 28*a* of a connecting pipe 28 that extends downward from the water storage tank 4*a* and is connected to an inlet (not illustrated) in a rear surface of the toilet body 8.

Next, as illustrated in FIGS. 2 and 4, the pair of left and right leg frames 18 and 20 of the fixing unit 6 are legs that extend downward from the toilet fixing lateral frame 16 and are fixed to the floor F1 in the area R1 behind the wall W1.

Further, as illustrated in FIGS. 2 and 4, the left lower lateral frame 22 of the fixing unit 6 connects the left leg frame 18 and the lower end of the left vertical frame 10 outside the left leg frame 18. Likewise, the right lower lateral frame 24 of the fixing unit 6 connects the right leg frame 20 and the lower end of the right vertical frame 12 outside the right leg frame 20.

Next, as illustrated in FIGS. 2 to 5, the drain pipe connection 26 of the fixing unit 6 is provided at a lower end of the toilet fixing lateral frame 16. The drain pipe connection 26 enables an inlet 30*a* of a drain pipe 30 extending to be close to the lower end of the toilet fixing lateral frame 16 from the floor F1 in the area R behind the wall W1 and a discharge outlet 8*a* at a rear side of the toilet body 8 to be connect to each other via the wall W1.

Next, as illustrated in FIG. 5, the pair of leg frames 18 and 20 are disposed outside of the drain pipe connection 26 and inside of a side wall 8*b* of the toilet body 8 in elevation view in a state where the toilet body 8 is fixed to the toilet fixing lateral frame 16.

Further, as illustrated in FIGS. 4 and 5, the pair of leg frames 18 and 20 are disposed laterally asymmetrically to each other with respect to the central axis A1 passing through a center O1 of the inlet 30*a* of the drain pipe 30, which is a center of the drain pipe connection 26 and dividing the fixing unit 6 equally in a left-right direction of the fixing unit 6 in elevation view.

That is, as illustrated in FIG. 5, a distance L1 in a horizontal direction from the central axis A1 of the fixing unit 6 to the left leg frame 18 is set to be larger than a distance L2 in the horizontal direction from the central axis A1 to the right leg frame 20 (L1>L2).

Further, as illustrated in FIG. 3, for example, when a user sits on the toilet seat (not illustrated) of the flush toilet 2 at a time of use of the flush toilet 2, a load P1 acts on the top surface of the toilet body 8 downward in the vertical direction. Further, by the load P1, a load P2 acts toward the respective leg frames 18 and 20 from the rear of the toilet body 8 via the wall W1 behind the rear.

Thereby, as illustrated in FIGS. 3 to 5, respective front end surfaces of the pair of leg frames 18 and 20 are load receiving surfaces S1 and S2 that receive the load P2 acting from the rear of the toilet body 8 like this.

Further, as illustrated in FIG. 5, lowest positions of the respective load receiving surfaces S1 and S2 of the pair of leg frames 18 and 20 are set at substantially the same height position as the lower end of the toilet body 8 above the floor F1.

Further, as illustrated in FIG. 5, a distance H1 in the vertical direction from the floor F1 to the lowest positions of the respective load receiving surfaces S1 and S2 of the respective leg frames 18 and 20 is preferably set at 55 mm to 182 mm, and a distance H2 is preferably set at 370 mm to 390 mm.

Next, as illustrated in FIGS. 2 to 5, the wall-mounted type toilet fixing device 1 of the present embodiment further includes a water supply main pipe 32 provided to be capable of being hidden in the area R1 behind the wall W1. The water supply main pipe 32 can supply flush water supplied from a supply water source (not illustrated) such as a city water at an upstream side thereof to each of the flush water tank device 4 and the warm water washing device 2*a* of the flush toilet 2.

Further, the fixing device 1 further includes a stopcock 36 provided in a connecting portion connecting a water supply pipe 34 for warm water washing that extends from the warm water washing device 2*a* and the water supply main pipe 32.

The stopcock 36 is attached to the left leg frame 18 which is located at a more distal side than the right leg frame 20 with respect to the central axis A1 of the fixing unit 6, out of the pair of leg frames 18 and 20.

Further, as illustrated in FIGS. 3 to 5, a front end of the stopcock 36 is disposed at a height position between the floor F1 and a lower end 8*c* of the toilet body 8 to be accessible from a front side of the wall W1.

Next, as illustrated in FIGS. 2 to 5, the wall-mounted type toilet fixing device 1 of the present embodiment further includes a power supply cable 38 that is a power supply portion which is provided to be capable of being hidden in the area R1 behind the wall W1 and supplies power to the respective electric components (not illustrated).

The power supply cable 38 has an upper end thereof connected to the respective electric components (not illustrated) inside the flush water tank device 4, and a lower end (a power supply portion) of the power supply cable 38 is connected to a power supply connection 40 of the toilet seat unit A with warm water washing function.

Further, a power outlet 42 is disposed on a surface of the wall W1 which is adjacent under the power supply connection 40, and a power cord (not illustrated) extending from the toilet unit A is connected to the power outlet 42.

Power which is supplied to the toilet seat unit A from the power outlet 42 via the power cord (not illustrated) is supplied to the respective electric components (not illustrated) of the flush water tank device 4 via the power supply cable 38 from the power supply connection 40, besides being supplied to the warm water washing device 2*a* and the like.

Further, as illustrated in FIGS. 2 to 5, in the present embodiment, the lower end (the power supply portion) of the power supply cable 38 and the power supply connection 40, and the power outlet 42 are disposed in a vicinity of an outside of the right leg frame 20.

However, the power supply connection 40 and the power outlet 42 are hidden inside from a right side surface of the toilet body 8 in the state where the rear end portion of the toilet body 8 is fixed to the wall W1, and therefore are disposed in a position that is hard to see from outside.

Incidentally, as illustrated in FIG. 5, a distance L3 in a left-right horizontal direction to the stopcock 36 from the central axis A1 of the fixing unit 6 in elevation view is set at 80 mm to 95 mm.

As illustrated in FIG. 5. a distance H3 in the vertical direction from the floor F1 to the stopcock 36 is set at 30 mm to 157 mm.

According to the wall-mounted type toilet fixing device 1 according to the first embodiment of the aforementioned present invention, a position in the vertical direction of the toilet fixing lateral frame 16 of the fixing unit 6 is located below the intermediate position M1 in the vertical direction between the floor F1 in the area R1 behind the wall W1 and the upper ends of the both of the vertical frames 10 and 12.

Further, the pair of leg frames 18 and 20 in the state where the toilet body 8 is fixed to the toilet fixing lateral frame 16 are disposed outside from the drain pipe connection 26 and inside from the side wall 8*b* of the toilet body 8 in elevation view. In addition, the respective front end surfaces of the pair of leg frames 18 and 20 are the load receiving surfaces S1 and S2 which receive the load P2 which acts toward the leg frames 18 and 20 via the wall W1 from the rear of the toilet body 8 at the time of use of the flush toilet 2.

Thereby, the load receiving surfaces S1 and S2 of the respective leg frames 18 and 20 can be limited to a small range, as compared with a case where the respective leg frames 18 and 20 are disposed outside from the side wall 8*b* of the toilet body 8 in elevation view. Thereby, a deformation amount by the entire wall-mounted type toilet fixing device 1 bending or the like can be restrained by the load P2 that acts toward the respective leg frames 18 and 20 via the wall WI from the rear of the toilet body 8.

Accordingly, the fixing unit 6 can hide the flush water tank device 4 in the area R1 behind the wall W1 and fix the flush water tank device 4 reliably, and can reliably fix the rear end portion of the toilet body 8 of the flush toilet 2 to the wall W1.

Further, the pair of leg frames 18 and 20 are disposed laterally asymmetrically to each other with respect to the central axis A1 passing through the center O1 of the inlet 30*a* of the drain pipe 30 and dividing the fixing unit 6 equally in the left-right direction of the fixing unit 6.

Thereby, the pair of leg frames 18 and 20 of the fixing unit 6 can be freely positioned in an area outside from the drain pipe connection 26 and the drain pipe 30 and inside from the side walls 8*b* of the toilet body 8 in elevation view, in the area R1 behind the wall W1.

Consequently, for example, equipment that supplies water to and equipment that supplies power to the warm water washing device 2*a* of the flush toilet 2 and the flush water tank device 4 can be positioned in peripheries of the leg frames 18 and 20, and the degree of freedom can be enhanced.

Further, according to the wall-mounted type toilet fixing device 1 according to the present embodiment, the stopcock 36 is fixed to the left leg frame 18 out of the pair of leg frames 18 and 20, and the front end of the stopcock 36 is disposed at the height position between the floor F1 and the lower end 8*c* of the toilet body 8 to be accessible from the front side of the wall W1.

Thereby, an installation space for the stopcock 36 can be ensured in the area R1 behind the wall W1, and the stopcock 36 can be disposed in a position that is hard to see from outside.

Further, when a water stopping operation is performed at a time of emergency and in maintenance at a normal time, an access can be easily made to the front end of the stopcock 36, so that a water stop operation can be easily performed.

Further, most part of the stopcock 36 other than the front end can be hidden by the wall W1, irrespective of the shape of the toilet body 8, so that the device can be made hard to be restricted by the shape of the toilet body 8.

Therefore, the device can also correspond to the toilet bodies 8 of various designs.

Further, according to the wall-mounted type toilet fixing device 1 according to the present embodiment, the power supply connection 40 and the power outlet 42 are disposed in the vicinity of the outside of the right leg frame 20 out of the pair of leg frames 18 and 20, so that an installation space for the power supply connection 40 can be ensured in the area R1 behind the wall W1, and the power supply connection 40 and the power outlet 42 can be disposed at a position that is hard to see from outside.

Further, irrespective of the shape of the toilet body 8, the power supply connection 40 and the power outlet 42 can be hidden by the wall W1 and the toilet body 8. so that they can be made hard to be restricted by the shape of the toilet body 8.

Therefore, they can correspond to the toilet bodies 8 of various designs.

Further, according to the wall-mounted type toilet fixing device 1 according to the present embodiment, the distance L1 in the horizontal direction from the central axis A1 of the fixing unit 6 to the left leg frame 18 is set to be larger than the distance L2 in the horizontal direction from the central axis A1 to the right leg frame 20 (L1>L2). Further, the stopcock 36 is fixed to the left leg frame 18 which is located at the more distal side than the right leg frame 20 with respect to the central axis A1 of the fixing unit 6.

Thereby, the installation space for the stopcock 36 that is hidden in the area R1 behind the wall W1 can be ensured, and the stopcock 36 can be disposed at the position that is hard to see from the front side of the wall W1.

Further, the stopcock 36 can be disposed at the position where a water stopping operation can be easily performed from the front side of the wall W1 at the time of emergency and in the maintenance at the normal time.

Further, according to the wall-mounted type toilet fixing device 1 according to the present embodiment, as illustrated in FIG. 5, the distance L3 in the left-right horizontal direction to the stopcock 36 from the central axis A1 of the fixing unit 6 in elevation view is set at 80 mm to 95 mm.

Accordingly, the installation space for the stopcock 36 that is hidden in the area R1 behind the wall W1 can be ensured, and the stopcock 36 can be disposed in the position that is hard to see from the front side of the wall W1.

Further, the stopcock 36 can be disposed at the position where a water stopping operation can be easily performed from the front side of the wall W1 at the time of emergency and in maintenance at the normal time.

Further, according to the wall-mounted type toilet fixing device 1 according to the present embodiment, as illustrated in FIG. 5, a vertical distance H3 from the floor F to the stopcock 36 is set at 30 mm to 157 mm.

Accordingly, the installation space for the stopcock 36 that is hidden in the area R1 behind the wall W1 can be ensured, and the stopcock 36 can be disposed at the position that is hard to see from the front side of the wall W1.

Further, the stopcock 36 can be disposed at the position where a water stopping operation can be easily performed from the front side of the wall W1 at the time of emergency and in maintenance at the normal time.

Further, according to the wall-mounted type toilet fixing device 1 according to the present embodiment, the vertical distance H1 from the floor F1 to the lowest position of the load receiving surfaces S1 and S2 of the respective leg frames 18 and 20 is set at 55 mm to 182 mm.

Accordingly, the vertical distance H1 between the load receiving surfaces S1 and S2 of the respective leg frames 18 and 20, and the floor F1 can be set to be relatively short, so that even when the load acts on the load receiving surfaces S1 and S2 of the respective leg frames 18 and 20 via the wall W1 from the rear of the toilet body 8 at the time of use of the flush toilet 2, the deformation amounts of the leg frames 18 and 20 and the wall W1 at the front side thereof can be restrained.

Further, according to the wall-mounted type toilet fixing device 1 according to the present embodiment, the toilet system T in which the flush water tank device 4 is hidden in the area R1 behind the wall W1 and is fixed reliably, and the flush toilet 2 is reliably fixed to the wall W1 can be provided.

Next, with reference to FIGS. 6 and 7, the wall-mounted type toilet fixing device according to a second embodiment of the present invention will be described.

Figure 6:
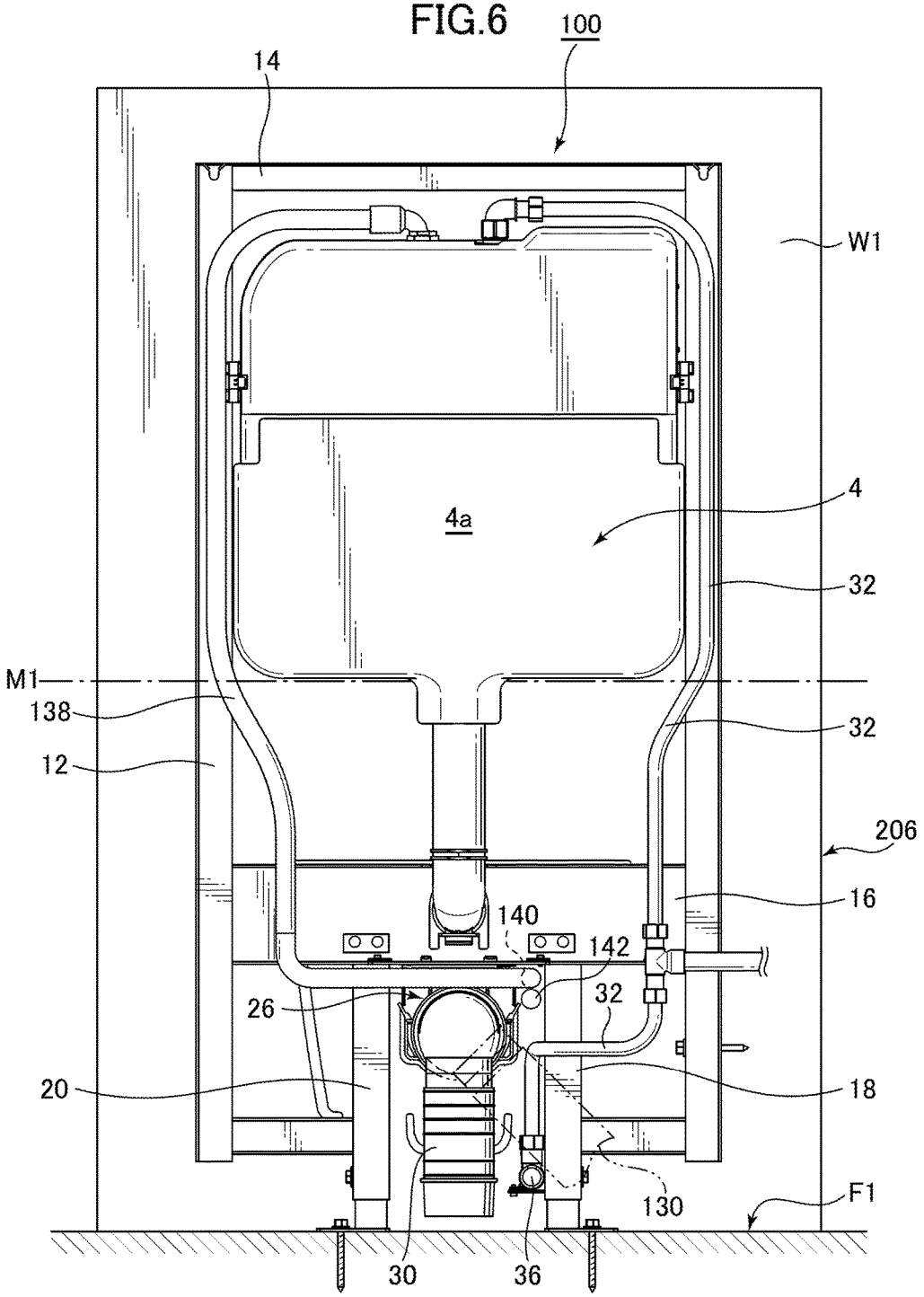
FIG. 6 is a rear view of a wall-mounted type toilet fixing device according to a second embodiment of the present invention and a wall.

FIG. 6 is a rear view of the wall-mounted type toilet fixing device according to the second embodiment of the present invention and a wall. Further, FIG. 7 is a front view of the wall-mounted type toilet fixing device according to the second embodiment of the present invention.

Figure 7:
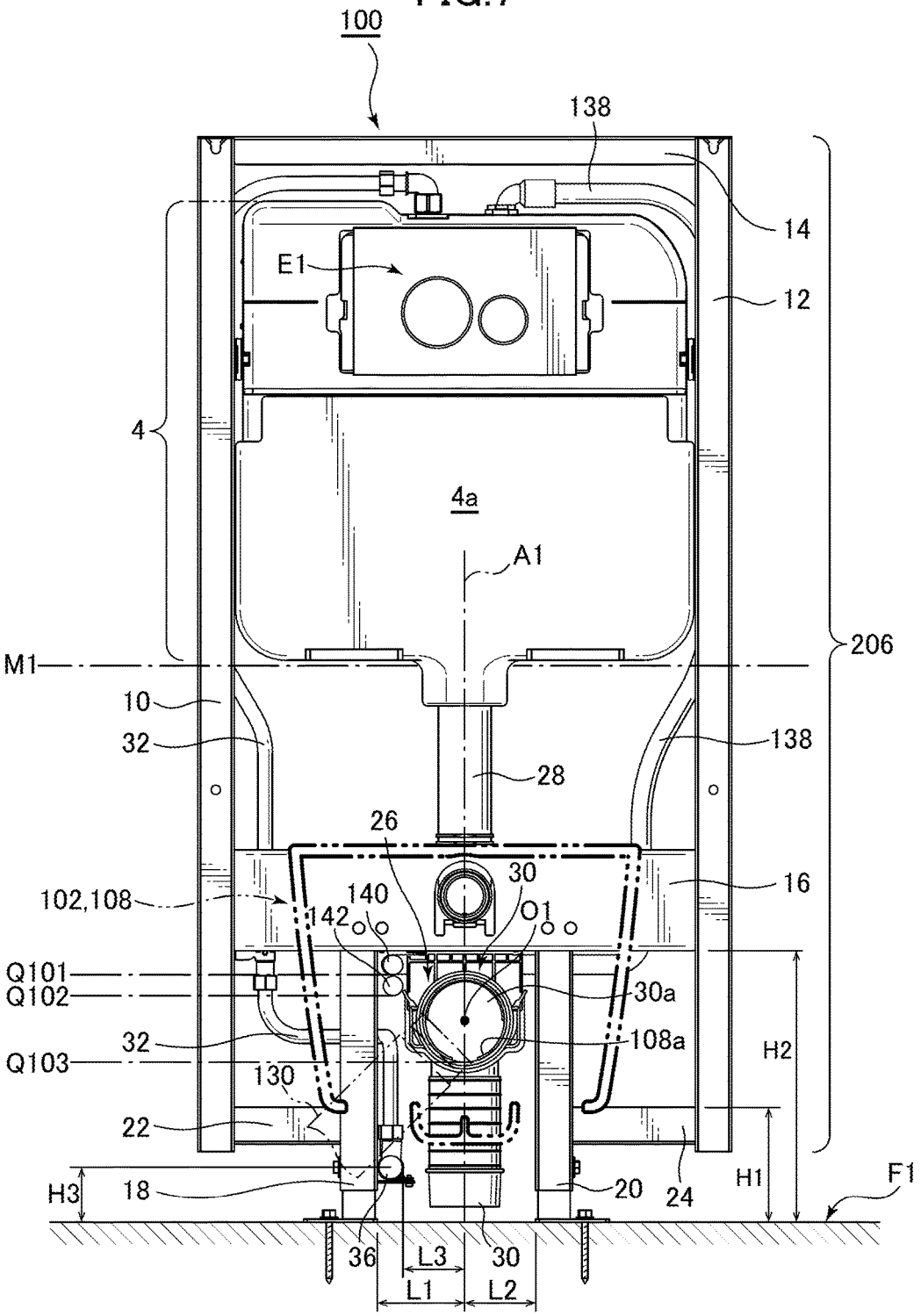
FIG. 7 is a front view of the wall-mounted type toilet fixing device according to the second embodiment of the present invention.
Figure 8:
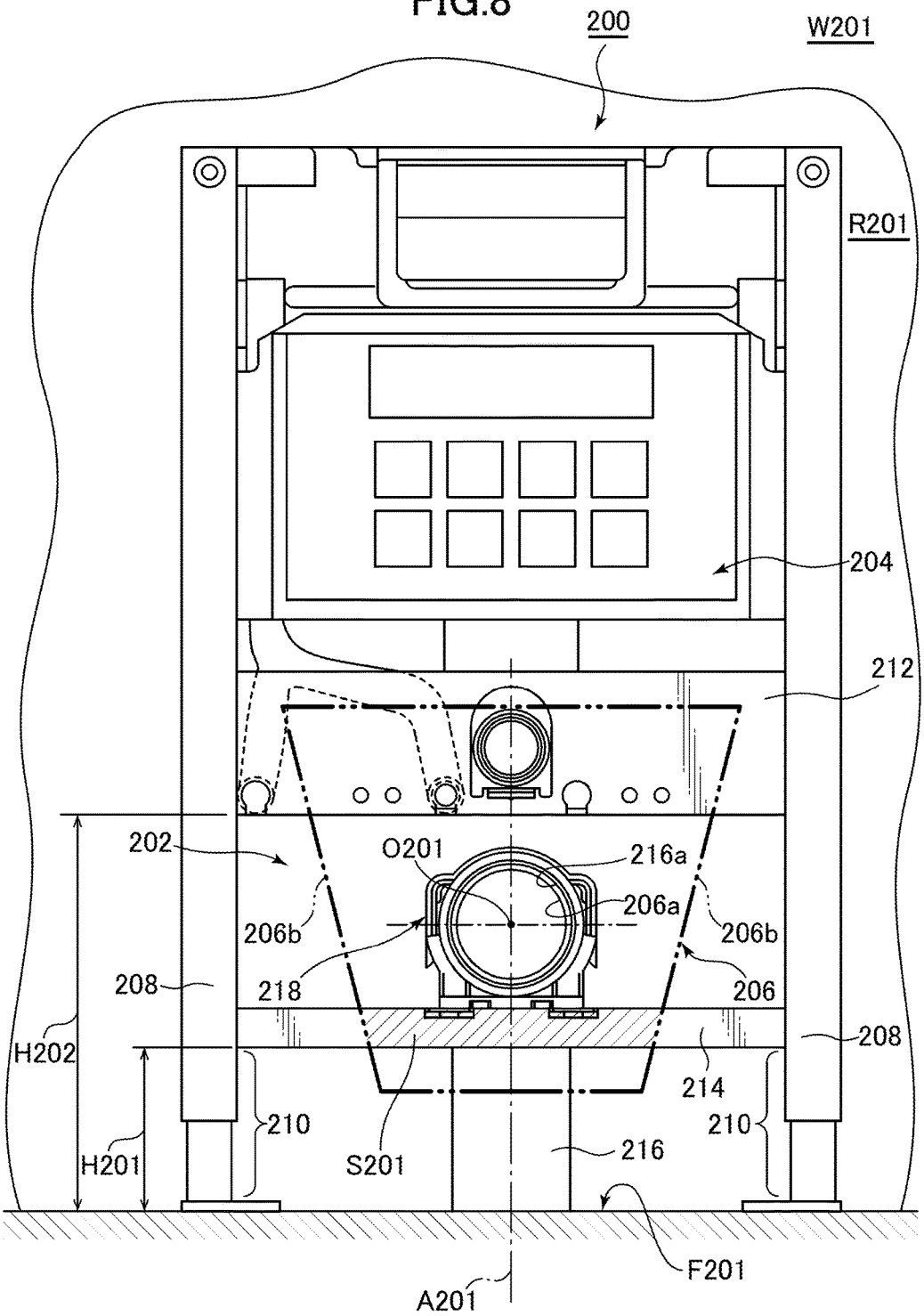
FIG. 8 is a schematic view illustrating a conventional wall-mounted type toilet fixing device.

Here, in the wall-mounted type toilet fixing device according to the second embodiment of the present invention illustrated in FIGS. 6 and 7, the same parts as the parts of the wall-mounted type toilet fixing device according to the first embodiment of the present invention described above will be assigned with the same reference signs, and explanation thereof will be omitted.

First, as illustrated in FIGS. 6 and 7, in a wall-mounted type toilet fixing device 100 according to the second embodiment of the present invention, a pair of leg frames 18 and 20 are disposed laterally asymmetrically to each other with respect to the central axis A1 passing through the center O1 of the inlet 30*a* of the drain pipe 30, which is the center of the drain pipe connection 26 in elevation view, and dividing a fixing unit 206 equally in a left-right direction, as in the wall-mounted type toilet fixing device 1 according to the aforementioned first embodiment.

As illustrated in FIG. 7, in the wall-mounted type toilet fixing device 100 according to the second embodiment of the present invention, the distance L1 in the horizontal direction from the central axis A1 of the fixing unit 206 to the left leg frame 18 (the first leg) is set to be larger than the distance L2 in the horizontal direction from the central axis A1 to the right leg frame 20 (the second leg) (L1>L2), as in the wall-mounted type toilet fixing device 1 according to the aforementioned first embodiment.

Further, with respect to a flush toilet 102 (a toilet body 108) illustrated by the chain line in FIG. 7, in a state where a rear end portion thereof is fixed to the wall Wi by the fixing unit 206, a lateral width in a horizontal left-right direction of the toilet body 108 is set to be larger than a distance (L1+L2) between an inner edge of the left leg frame 18 and an inner edge of the right leg frame 20.

However, the wall-mounted type toilet fixing device 100 according to the present embodiment adopts a structure in which a power supply connection 140 to which a lower end (a power supply portion) of a power supply cable 138 is connected is disposed inside from the first leg (the left leg frame 18) with the stopcock 36, and therefore differs from the structure of the wall-mounted type toilet fixing device 1 according to the first embodiment of the present invention described above in which the lower end (the power supply portion) of the power supply cable 38 and the power supply connection 40 are disposed in a vicinity of the outside of the right leg frame 20.

Further, as illustrated in FIGS. 6 and 7, in the wall-mounted type toilet fixing device 100 according to the present embodiment, the power cord outlet 142 that enables a power cord (not illustrated) extending to the toilet body 108 from the area R1 behind the wall W1 to be taken out is provided under the power supply connection 140.

Furthermore, the power supply connection 140 includes a connector member (not illustrated) that can connect a power supply cable (not illustrated) extending from the toilet seat unit A and the power supply cable 138 extending from the flush water tank device 4. The power supply connection 140 and the power cord outlet 142 are disposed above in a substantially vertical direction with respect to the stopcock 36. Power that is supplied from the power cord (not illustrated) in the area R1 behind the wall W1 to the toilet seat unit A via the power cord outlet 142 is supplied to respective electric components (not illustrated) and the like of the flush water tank device 4 via the power supply cable 138 from the power supply connection 140 besides being supplied to a warm water washing device 102*a* and the like.

As illustrated in FIG. 7, respective positions Q101 and Q102 of the power supply connection 140 and the power cord outlet 142 are located above a lower end position Q103 of the inlet 30*a* of the drain pipe 30.

Here, as illustrated in FIGS. 6 and 7, the drain pipe 30 in the wall-mounted type toilet fixing device 100 according to the present embodiment is illustrated in a mode of piping (so-called "vertical piping") installed in a posture extending in the vertical direction.

However, in the wall-mounted type toilet fixing device 100 according to the present embodiment, depending on an installation situation such as a position of piping at a downstream side of the drain pipe 30, a mode of piping (so-called "lateral piping") installed in a posture that is inclined with respect to the vertical direction is applicable as a drain pipe 130 schematically illustrated by the chain lines in FIGS. 6 and 7.

According to the wall-mounted type toilet fixing device 100 according to the second embodiment of the present invention described above, the distance L1 in the horizontal direction from the central axis A1 of the fixing unit 206 to the left leg frame 18 (the first leg) is set to be larger than the distance L2 in the horizontal direction from the central axis A1 to the right leg frame 20 (the second leg) (L1>L2), whereby a larger space is formed inside from the left leg frame 18 (the first leg) than inside from the right leg frame 20 (the second leg).

Accordingly, the space formed inside of the left leg frame 18 (the first leg) like this is effectively used as the installation space for the power supply connection 140 and the stopcock 36, whereby the respective stopcock 36, power supply connection 140 and power cord outlet 142 can be disposed at a position that is hard to see from the front side of the wall W1.

Further, a lateral width of the toilet body 108 is set to be larger than a distance (L1+L2) between the inner edge of the left leg frame 18 and the inner edge of the right leg frame 20, so that in the state where the rear end portion of the toilet body 108 is fixed to the wall W1 by the fixing unit 206, the respective stopcock 36, the power supply connection 140 and the power cord outlet 142 are disposed at a central side of the toilet body 108.

Accordingly, even when the toilet bodies 108 of various modes are applied, the respective stopcock 36, the power supply connection 140 and the power cord outlet 142 can be reliably hidden within the lateral width of the toilet body 108 (explaining more strictly, within a range of the distance (L1+L2) between the inner edge of the left leg frame 18 and the inner edge of the right leg frame 20).

Further, according to the wall-mounted type toilet fixing device 100 according to the second embodiment of the present invention, the power supply connection 140 and the power cord outlet 142 are disposed above in the substantially vertical direction with respect to the stopcock 36 and above the lower end of the inlet 30*a* of the drain pipe 30, so that the space in the vertical direction from the stopcock 36 to the power supply connection 140 and the power cord outlet 142 can be sufficiently ensured.

Accordingly, even under the situation in which piping (so-called "lateral piping") with the drain pipe 130 installed in the posture inclined with respect to the vertical direction is more preferable than piping (so-called "vertical piping") with the drain pipe 30 installed in the posture extending in the vertical direction due to the installation situation such as the position of the piping at the downstream side of the drain pipe 30, for example, the drain pipe 130 can be properly disposed in the space between the stopcock 36, and the power supply connection 140 and the power cord outlet 142.

Consequently, the vertical piping (the drain pipe 30) and the horizontal piping (the drain pipe 130) can be properly selected in accordance with the piping installation at the downstream side of the drain pipes 30 and 130, so that the device can be variously applied to various installation places.

Further, the power supply connection 140 is disposed inside of the left leg frame 18 (the first leg) with the stopcock 36, and is disposed above the stopcock 36 in the substantially vertical direction, whereby if one of the power supply connection 140 and the stopcock 36 is fixed to inside of the left leg frame 18 (the first leg) once, at the time of performing the work of fixing the power supply connection 140 and the stopcock 36 to inside of the left leg frame 18 (the first leg), the other one also can be easily positioned and fixed to inside of the left leg frame 18 (the first leg), so that workability can be enhanced.

What is claimed is:

1. A toilet fixing device for fixing a rear side of a flush toilet including a warm water washing device to a wall, the wall-mounted type toilet fixing device comprising:

a flush water tank device configured to supply flush water to the flush toilet, the flush water tank device being disposed behind the wall so as to be hidden by the wall; and a fixing unit that is disposed behind the wall so as to be hidden by the wall, the fixing unit being configured to fix the flush water tank device and to fix a rear end portion of a toilet body of the flush toilet to the wall, wherein the fixing unit includes:

a pair of left and right support portions that are configured to extend in a vertical direction at both left and right sides of the flush water tank device and to support the flush water tank device, a toilet fixing portion extending in a left-right direction to connect the pair of left and right support portions, the toilet fixing portion being configured to fix the rear end portion of the toilet body via the wall, a pair of left and right legs extending downward from the toilet fixing portion, the pair of left and right legs being fixed to a floor in an area behind the wall, and a drain pipe connection disposed in the toilet fixing portion, the drain pipe connection being configured to connect an inlet of a drain pipe extending from the floor in the area behind the wall to be close to the toilet fixing portion and a discharge outlet at a rear side of the toilet body via the wall, wherein the toilet fixing portion is located below an intermediate position between the floor in the area behind the wall and upper ends of the support portions, the pair of legs are disposed outside from the drain pipe connection and inside from a side wall of the toilet body in elevation view, and are disposed laterally asymmetrically to each other with respect to a central axis passing through a center of the drain pipe connection and dividing the fixing unit equally in the left-right direction, in a state where the toilet body is fixed to the toilet fixing portion, and respective front end surfaces of the pair of legs are load receiving surfaces configured to receive a load acting toward the legs from a rear of the toilet body via the wall at a time of use of the flush toilet.

2. The toilet fixing device according to claim 1, further comprising:

a water supply main pipe configured to supply flush water supplied from a water supply source to the respective flush water tank device and warm water washing device, the water supply main pipe being disposed behind the wall so as to be hidden by the wall; and a stopcock disposed on a connecting portion configured to connect the water supply main pipe and a water supply pipe for warm water washing extending from the warm water washing device, wherein the stopcock is fixed to either one of the pair of legs, and a front end of the stopcock is disposed at a height position between the floor and a lower end of the toilet body so as to be accessible from a front side of the wall.

3. The toilet fixing device according to claim 2, wherein the pair of legs include a first leg and a second leg, a first distance to the first leg from the central axis dividing the fixing unit equally in a left-right direction is set to be longer than a second distance from the central axis to the second leg, and the stopcock is fixed to the first leg.

4. The toilet fixing device according to claim 3, further comprising:

an electric component disposed on the flush toilet or the flush water tank device; and a power supply connection configured to be hidden in the area behind the wall, wherein a power supply portion supplying power to the electric component is connected to the power supply connection, wherein the power supply connection is disposed inside of the first leg with the stopcock.

5. The toilet fixing device according to claim 4, wherein the power supply connection is disposed above in a substantially vertical direction with respect to the stopcock and above a lower end of the inlet of the drain pipe.

6. The toilet fixing device according to claim 3, wherein a distance in a left-right horizontal direction from the central axis to the stopcock is set at 80 mm to 95 mm.

7. The toilet fixing device according to claim 3, wherein a distance in the vertical direction from the floor to the stopcock is set at 30 mm to 157 mm.

8. The toilet fixing device according to claim 1, further comprising:

an electric component disposed in the flush toilet or the flush water tank device; and a power supply connection configured to be hidden in the area behind the wall, wherein a power supply portion supplying power to the electric component is connected to the power supply connection, wherein the power supply connection is disposed in a vicinity of an outside of either one leg of the pair of legs.

9. The toilet fixing device according to claim 1, wherein a distance in the vertical direction from the floor to a lowest position of the load receiving surfaces of the legs is set at 55 mm to 182 mm.

10. A toilet system, comprising the toilet fixing device according to claim 1, and the flush toilet fixed to the toilet fixing device via the wall.

* * * * *